US005454448A

United States Patent [19]

Bittar et al.

[11] Patent Number: 5,454,448

[45] Date of Patent: Oct. 3, 1995

[54] ELEVATOR CALL BUTTONS HAVING PLURAL ILLUMINATED INDICATIONS OF AVAILABILITY AND USE

[75] Inventors: Joseph Bittar, Avon; Thomas R. Bean, Simsbury, both of Conn.; Charles J. Proctor, Singapore, Singapore

[73] Assignee: Otis Elevator Company, Farmington, Conn.

[21] Appl. No.: 964,540

[22] Filed: Oct. 21, 1992

[51] Int. Cl.[6] ..... B66B 1/14; B66B 3/00

[52] U.S. Cl. ..... 187/395; 187/384

[58] Field of Search ..... 187/126, 21, 130, 187/128; 200/312, 314

[56] References Cited

U.S. PATENT DOCUMENTS

| | | | |
|---|---|---|---|
| 4,805,739 | 2/1989 | Lind et al. | 187/121 |
| 4,836,336 | 6/1989 | Schroder | 187/121 |
| 4,915,197 | 4/1990 | Schroder | 187/121 |

FOREIGN PATENT DOCUMENTS

| | | | |
|---|---|---|---|
| 0288584 | 11/1989 | Japan | 187/130 |
| 0123081 | 5/1990 | Japan | 187/139 |
| 0008677 | 1/1991 | Japan | 187/136 |
| 0095090 | 4/1991 | Japan | 187/130 |
| 3-147685 | 6/1991 | Japan | B66B 1/16 |

OTHER PUBLICATIONS

Abstract of Japanese Patent Application 01-288585, Dated Nov. 1989.

*Primary Examiner*—Thomas M. Dougherty
*Assistant Examiner*—Robert Nappi

[57] ABSTRACT

Elevator car call buttons and hall call buttons are illuminated in a first fashion (such as a first color or intermittent flashing) to indicate that the service corresponding to that call button is available to passengers (while buttons corresponding to unavailable service would have either no illumination or different illumination); the buttons then become illuminated in a distinctly different way when a service call corresponding to that button has been registered. The illumination may be thin rings surrounding the call button switch or the call button switch itself; many variations of color, position, and flashing vs. steady are disclosed.

4 Claims, 5 Drawing Sheets

GREEN/RED

FLASHING/STEADY

GREEN/RED

RING/CENTER

FLASHING/STEADY

ELEVATOR CALL BUTTONS HAVING PLURAL ILLUMINATED INDICATIONS OF AVAILABILITY AND USE

TECHNICAL FIELD

This invention relates to elevator hall call and car call buttons which have plural illuminated appearance for indicating the availability of service to the floor related to the button and for indicating that a request for service to the floor has been made and/or registered.

BACKGROUND ART

Elevators serving the same corridors on a plurality of floors of a building are usually operated in groups (typically, four to eight per group). A group of elevators may serve all the floors in the building, or may serve contiguous sections of the building, as in a low rise group, a medium rise group, and a high rise group. A recent innovation utilized principally during morning up-peak traffic in a typical office building further divides the elevator service into subgroups of floors so as to provide faster overall service to large numbers of passengers traveling to the various floors from the lobby. In state-of-the-art elevators, the allocation of elevators within the group to specific floors of a subgroup is called channeling, and is described in commonly owned U.S. Pat. Nos. 4,792,019; 4,804,069; 4,838,384; and 4,846,311; and in commonly owned U.S. patent application of Thangavelu, Ser. No. 07/957,569 filed on Apr. 21, 1990, and other U.S. patent applications cited therein. In such a system, each time an elevator car returns to the lobby it is assigned to the next subgroup, e.g., floors 2–6, and that fact is displayed to passengers in the corridor so that they can select the proper elevator car to enter. The next time that same elevator approaches the lobby, it may be assigned to floors of a different subgroup, e.g., floors 7–12. Again, the floors to which it is assigned are announced to passengers by an electronic display in the corridor, so they may enter the proper elevator.

In each case, car calls will be accepted only to the floors of the assigned subgroup. Thus, in the first instance, only the car call buttons for floors 2–6 are operative, the remaining car call buttons (e.g., floors 7–21) are not operative. However, persons have a habit of not paying much attention and getting on the wrong elevator; similarly, passengers who are visiting and entering the building during the rush hour are likely to forget the floor which they are visiting and seek to enter a call on the wrong floor. In order to accommodate this situation, state-of-the-art elevators may typically have an electronic display on the car operating panel near the car call buttons reminding passengers which subgroup of floors are being serviced at this time by this elevator. Such a display indicates the available floors until the elevator leaves the lobby, and then reverts to its usual task of designating the floor position of the elevator as it proceeds to and through the subgroup of floors. However, an electronic display capable of illustrating the floors currently being served is far more expensive than is necessary for a simple floor position indicator. Furthermore, in the rush of entering a crowded elevator (perhaps with a door starting to close and reopening), passengers frequently simply seek out a car call button and do not read any displays. In buildings demanding the highest quality of service, this sort of irritation may not be tolerable.

In a recent innovation, disclosed in a commonly owned, co-pending U.S. patent application entitled "Cyclically Varying Elevator Grouping", Ser. No. 07/887,946 filed on May 26, 1992 by Bittar, specially designed cars are capable of serving different rises of multi-rise elevator systems, having a low rise and high rise or a low rise, a medium rise, and a high rise. Thus, any such elevator car may be assigned during one run to handle passengers only within the low rise group, and may be assigned in another run to handle passengers in a medium rise group, etc. In some installations, it is possible that all of the car call buttons adjacent to a given door are only related to the floors served from the corridor onto which that door opens; that is, if entering from the lobby corridor serving the mid-rise, the panels adjacent the doors through which the passenger has entered contain only mid-rise car call buttons; if entering from a corridor serving passengers to a high rise, only car call buttons relating to the high rise floors will be found in the panels adjacent to the door through which the passenger has entered. On the other hand, it may be desirable for a variety of reasons to have all car call buttons, or more than one rise of car call buttons, adjacent to one or more of the doors of a swing car of the Bittar application. In such a case, the problems of identifying the car call buttons which may be utilized by the passengers, described hereinbefore with respect to channeling, are applicable to swing cars. A similar situation may exist in other swing car installations where a car may be operating in a simplex mode with respect to only certain of the floors of its normal group. A swing car elevator configuration of this type is disclosed in commonly owned co-pending U.S. patent application entitled "Elevator Car and Riser Transfer" Ser. No 07/853,678, filed on Mar. 19, 1992 by Meguerdichian et al now U.S. Pat. No. 5,272,287, issued Dec. 20, 1993. Another situation in which less than all of the floors relating to car call buttons on a car operating panel are available to passengers, or where hall calls might not be available to passengers, are in state-of-the-art elevator systems having selective security. Thus, a given floor or set of floors might be blocked out for security purposes, or service from a given floor may be allowed only in the down direction and not in the up direction. In these situations, it can be extremely frustrating if there is no indication to potential passengers of the availability or not of the service which may be requested by pressing a call button. A security system of this general type is illustrated in a commonly owned, co-pending U.S. patent application entitled "Adaptive Elevator Security System", Ser. No. 07/785,738 filed on Oct. 31, 1991 by Kupersmith et al now U.S. Pat. No. 5,200,583, issued Apr. 6, 1993.

An elevator hall lantern for distinctively announcing the arrival of up-travelling and down-travelling cars at a floor, capable of displaying distinctive up and down direction indications from a single, common display area employing dual lights, is disclosed in commonly owned, co-pending U.S. patent application entitled "Single, Bi-Color Elevator Hall Enunciator Lantern" Ser. No. 07/937,094, filed on Aug. 31, 1992 by Proctor. All of the foregoing patents and applications are incorporated herein by reference.

DISCLOSURE OF INVENTION

Objects of the invention include provision of elevator call buttons with easily recognized indications of availability of service which can be requested by pressing the button and registration of such a request for service. According to the invention, elevator call buttons have a plurality of selectable visually distinct illumination appearance characteristics conditions to indicate that a given button may be utilized to request service and to indicate further when corresponding service is requested and/or registered. The invention includes identifying, by suitable illumination of corresponding car call buttons on the car operating panel in an elevator car, those floors at which stops may be requested, and identifying, by suitable illumination of up hall call buttons and down hall call buttons, whether passengers are permitted to travel in the up or down direction (respectively) from a given floor, as well as identifying by different, distinct illumination when one such permitted call has been requested and/or registered. The plural distinct illumination appearances of the call buttons, that is, illumination providing distinct visual impressions to passengers, include: flashing illumination indicating availability followed by steady illumination indicating registration of a call; illumination of one color indicating availability and illumination of another color indicating registration of a call; illumination of a ring indicating availability and illumination of the center within the ring indicating a registered call; illumination of one part in one color indicating unavailability, illumination of such part in another color indicating availability; variations, conversions and combinations of the foregoing; as well as other multiple illumination appearances, such as variations in intensity or hue. The invention may be used in any number of shapes to accommodate car call buttons within the elevator car as well as up and down hall call buttons in the service corridors of the various floors.

The invention is useful in new installations and in retrofitting existing installations with relative ease and can provide savings in spare parts and maintenance costs. The invention may be practiced in a wide variety of forms utilizing only technology and apparatus which is readily available in the light of the teachings which follow hereinafter.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
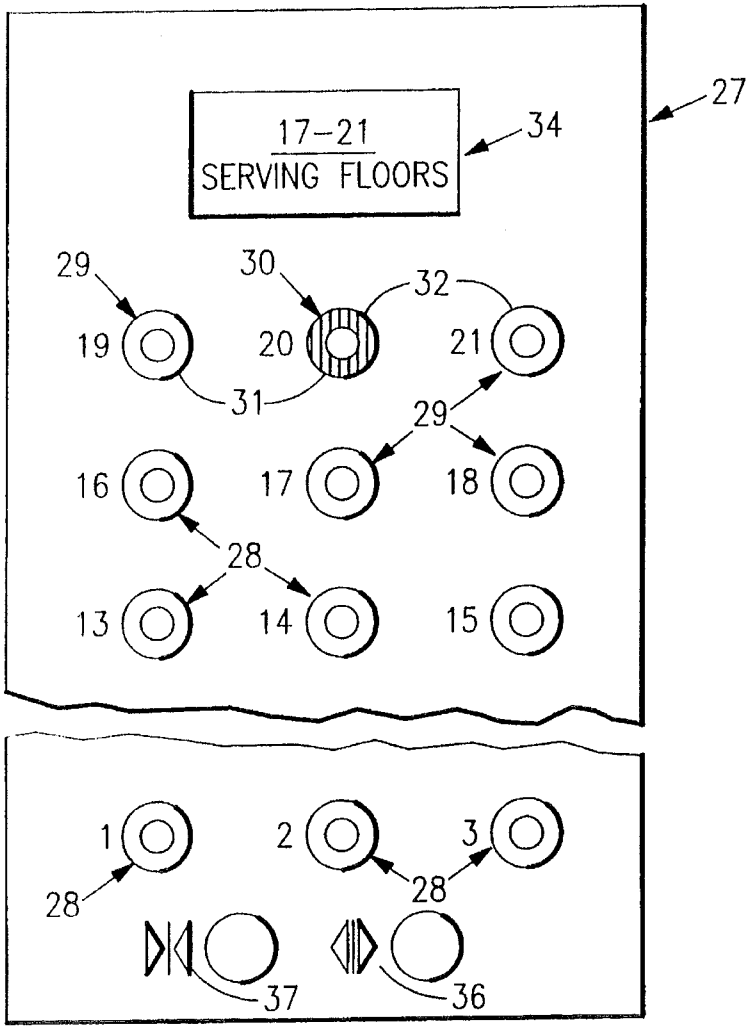
FIG.1 Prior Art
FIG. 1 is a front view of a car operating panel having elevator buttons and an electronic display in accordance with the prior art.

Referring to FIG. 1, state-of-the-art car operating panel (COP) 27 includes a plurality of car call buttons 28–30 each having an outer ring area 31 which illuminates when a car call is registered for the corresponding floor, and a central switch area 32, the pressing of which causes the request for the car call to be manifested and eventually registered (if permitted). In this type of COP, there is no illumination of the central switch area 32. The most common COPs known in the elevator art (not shown herein) have either a square or a round car call button which, when pressed, illuminates to indicate the registering of a car call. When used in a channeling system of the type described hereinbefore, an illuminated display 34 will provide a legend indicative of the floors being served, illustrated in FIG. 1 as being floors 17–21, by way of example. In such a case, the buttons 28 for floors 1–16 will all be inoperable, and the buttons 29, 30 for floors 17–21 will be operable. Should any of these buttons be pressed, the ring thereof will illuminate, as illustrated by the button 30 which is lined for red, indicating registration of a call for the 20th floor. Also illustrated in FIG. 1 are door open and door close buttons and their corresponding markings 36, 37 which have nothing to do with the present invention. As seen in FIG. 1, the trouble with prior art COPs when used with channeling or in swing car operation is that there is no visible difference between the buttons 28 and the buttons 29, 30. Persons in a rush may not take any notice of the illuminated display 34. Therefore, there is less than the best guidance as to which buttons may be pressed.

Figure 2:
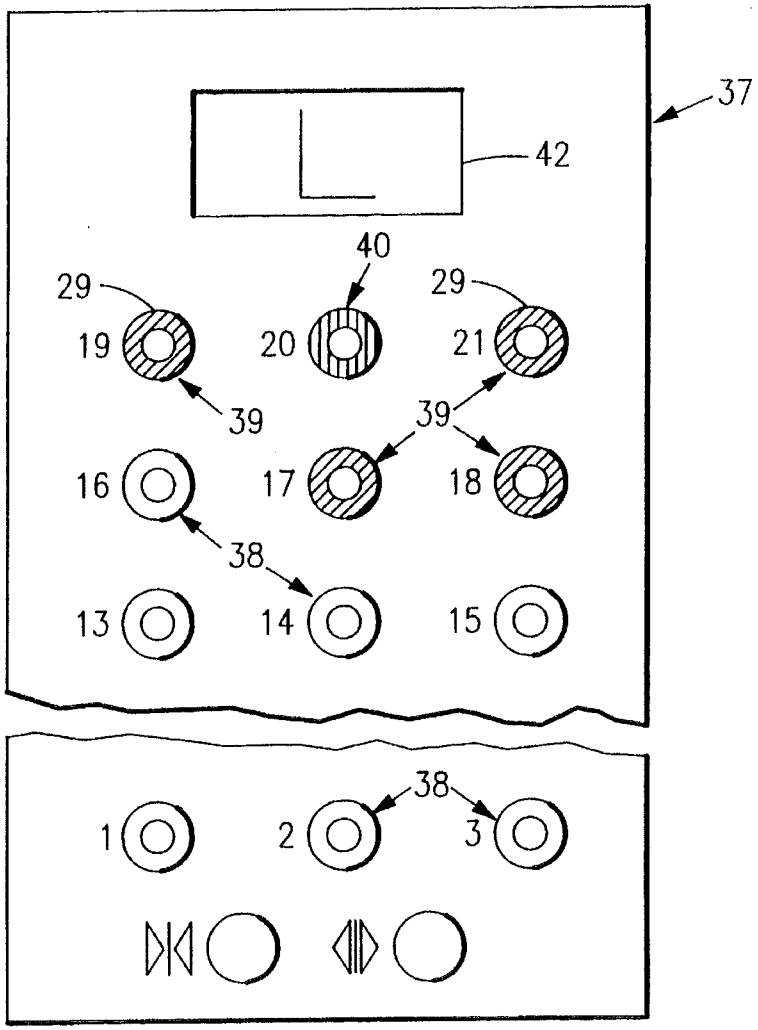
FIG. 2 is a front view of a car elevator panel having red and green car call buttons in accordance with the invention.

Referring now to a COP 37 in FIG. 2, a plurality of buttons 38 (corresponding to the buttons 28) relate to floors 1–16 which are not available and the buttons 39 and 40 relate to floors 17–21 which are available for service. The buttons 39 are lined for the color green, indicating that the outer rings 29 thereof are illuminated in green light whereas the button 40 for the 20th floor is lined for red indicating that someone has pressed it to request service to the 20th floor and the color has consequently changed from green to red, in accordance with one embodiment of the invention. Since the available floors are indicated by the initially green light emanating from the outer rings of buttons 39, 40, there is no need to have an illuminated display, such as the display 34 in FIG. 1, to indicate which floors are available. Therefore, an illuminated display 42 is displaying L, meaning that the floor position indicator is indicating that the car is at the lobby floor. Since the display 42 need only indicate the letter L and numbers from 1–21, it can obviously be much simpler than the display 34, and therefore much less expensive. This is one aspect of the present invention.

Figure 3:
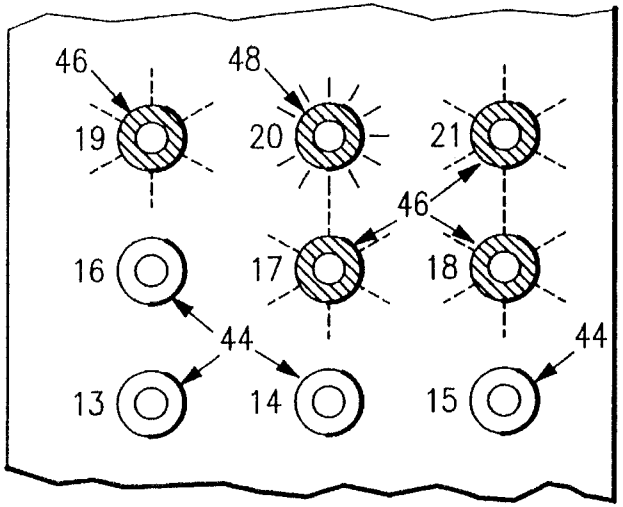
FIG. 3 is a partial front view of a car operating panel having car call buttons with flashing and steady illumination in accordance with the present invention.

In FIG. 3, another mode of implementing the present invention is illustrated. Therein, a plurality of elevator buttons 44 are shown as being not illuminated. A plurality of elevator buttons 46 have their outer rings lined loosely for green and have dash lines indicating that they are flashing (intermittent) green light. On the other hand, a button 48 is lined more heavily for green with small lines indicating a steady emanation of green light. Thus, the available floors are illustrated with flashing green light by the buttons 46, and a registered call for one of those floors is illustrated with solid (invariant) green light by the button 48.

Figure 4:
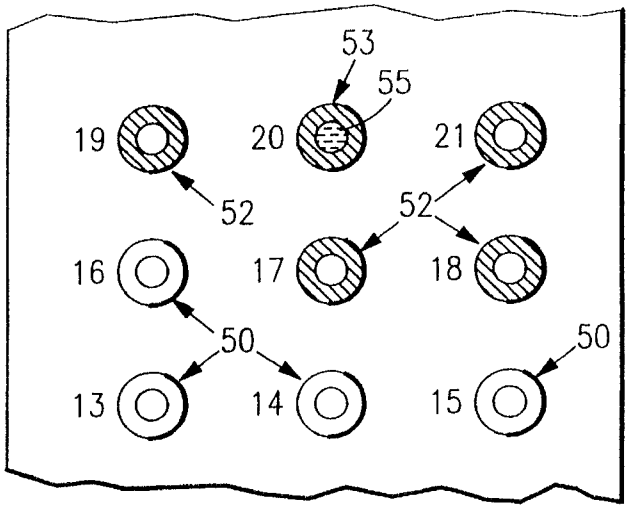
FIG. 4 is a partial front view of a car operating panel having car call buttons with separately lit ring and center portions in accordance with the present invention.

A third method of implementing the present invention is illustrated in FIG. 4 in which a plurality of buttons 50 are shown as not emanating any light, whereas a plurality of buttons 52, 53 are shown as having their outer rings emanating green light indicating that the corresponding floors are available for service. In addition, the center 55 of the button 53 is lined for gray or silver. In this manner of implementing the present invention, the available floors are indicated by illuminated rings, whereas the center portion 55, which is the button switch to be pressed for service, illuminates once the call is registered (illumination of the button switch to indicate making and/or registering a call is most common in prior art elevator buttons).

Figure 5:
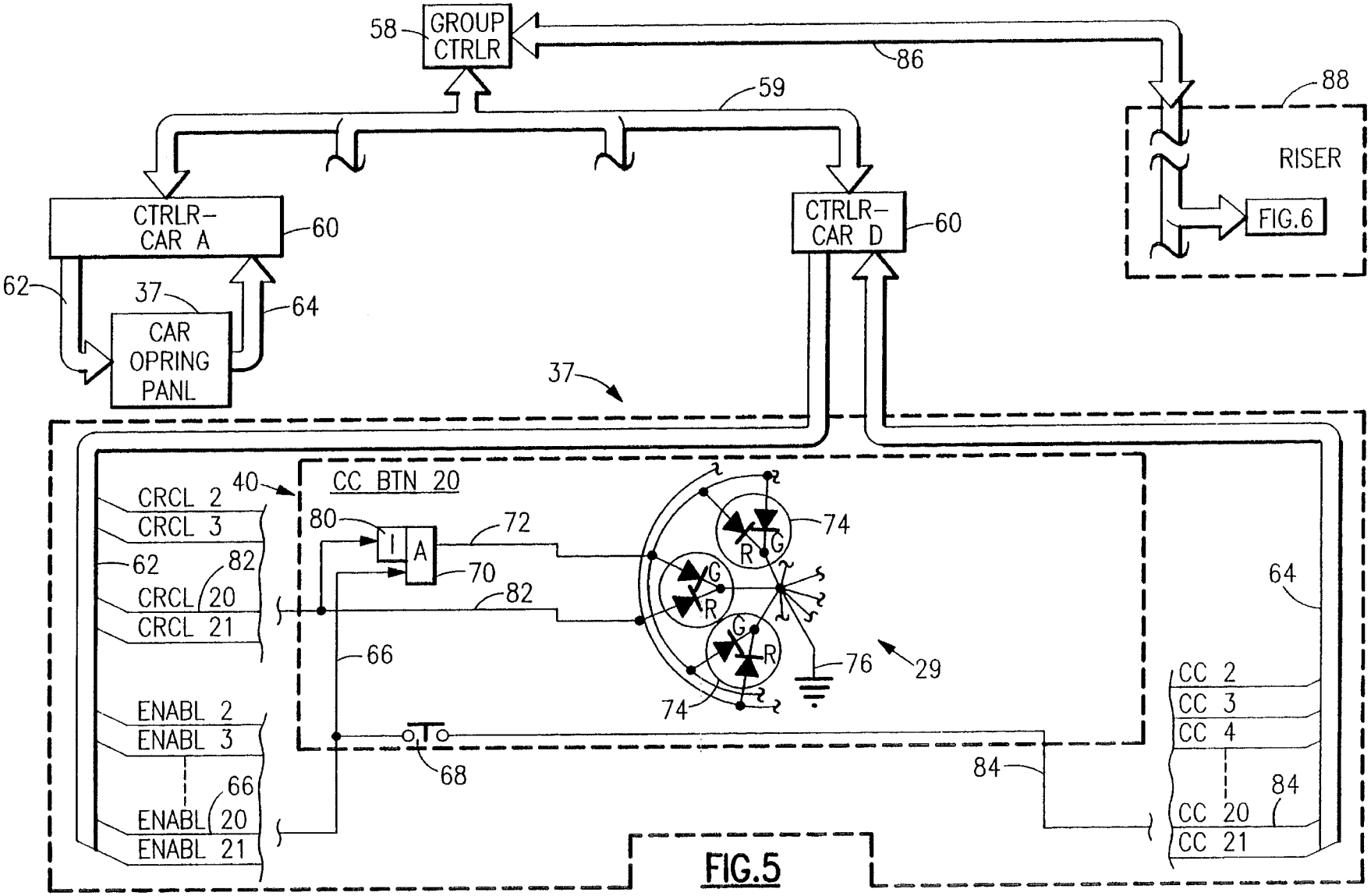
FIG. 5 is a simplified, partial schematic block diagram of an elevator system incorporating call buttons in accordance with the present invention, including the car call buttons of FIG. 2.

An elevator system having the COP 37 with buttons 38–40, illustrated in FIG. 5, typically includes a group controller which oversees the operation of a group of elevators, typically four to eight elevators in a group. In a channeling operation, it is the group controller 58 which determines which floors the elevator car will service in its next run, and therefore which buttons should be enabled in that elevator car. The group controller 58 communicates with a plurality of car controllers 60, each controlling the motion of a corresponding elevator car in a related hoistway. Each of the car controllers is connected by a traveling cable 62, 64 and communicates with a corresponding car operating panel 37 within the elevator car which contains the buttons and their immediate logic controls. Portions of the traveling cable relating to communications between the controllers 60 and the car operating panels 37 are illustrated herein by the trunk of downgoing lines 62 which take signals to the COP and the trunk of upgoing lines 64 which transmit signals from the COP to the controller 60.

For simplicity, only those connections relevant to an understanding of the present invention are shown herein. Within the trunk of lines 62 are a pair of lines for each floor, including an enable line for the floor and a car call acknowledgement for the floor. For the 20th floor, an enable line 66 (ENABL 20) is connected to a car call button switch 68, which may either be the center portion 32 of a ring-type car call button (as in FIGS. 1 and 2) or may comprise the entire button in the older, common car call buttons. The enable line 66 for floor 20 is also connected to an AND gate 70 that will, when appropriate, provide a signal on a line 72 to the green element portion of a plurality of dual light LEDs (light emitting diodes) 74, the other ends of which are referenced by suitable connections 76 to ground. The dual light LEDs may comprise AND/77RAG high intensity red/green dual LEDs provided by A.N.D. Co., Burlingame, Calif., or any other suitable dual light, light emitting diodes. The AND gate 70 will operate in response to a signal from an inverter 80 which will occur when there is no signal (CRCL 20) on a car call acknowledgement line 82 for floor 20. Thus, when a car reaches the lobby, is assigned to a set of floors, and passengers begin to enter, there will have been no car calls registered so there is no signal on the line 82 (or on CRCL lines for any other floors), whereby the inverters (like inverter 80) will allow all of the enabled floors (such as floor 20) to illuminate the ring portions of the call buttons with green light. Should a passenger elect to request service to the 20th floor, closure of the button 68 will cause a car call request signal (CC 20) on a line 84 to be transmitted through the corresponding trunk of lines 64 to the related controller 60 requesting recognition of a call for service to that floor. In the event that the call for service should be recognized, then the controller 60 will send a signal over the trunk of lines 62 to provide a signal on the car call acknowledge line 82 for floor 20, thereby blocking the output of the inverter 80 and the AND gate 70 so that the green element portions of the LED 74 are no longer illuminated. At the same time, the car call acknowledgement signal on the line 82 will energize the red element portions of the dual light LED 74 thus causing the color of the ring portion 29 of the car call button 40 to change from green to red. This is one example of plural illumination of service availability and call registration in accordance with the present invention.

Note that the call button switch 68 is ineffective unless the enable signal is present on the line 66. That is to say, it is the line 66 that determines if a call can be requested for the 20th floor. However, this need not be so, and the embodiment of FIG. 5 may be modified to be more like that of FIG. 7 (as described hereinafter) in allowing a call request signal to be generated through a call button switch 68, but the signal not be recognized (as in the prior art) due to screening thereof within the controller 60. It also should be understood that although the car call button switch 68 is shown separate from the LEDs 74, it is normally associated therewith such as by being within the center portion 31 of one of the buttons 28–30. The combination of the call button switch and indicators (LEDs, bulbs) is hereinafter referred to as a call button assembly.

Figure 6:
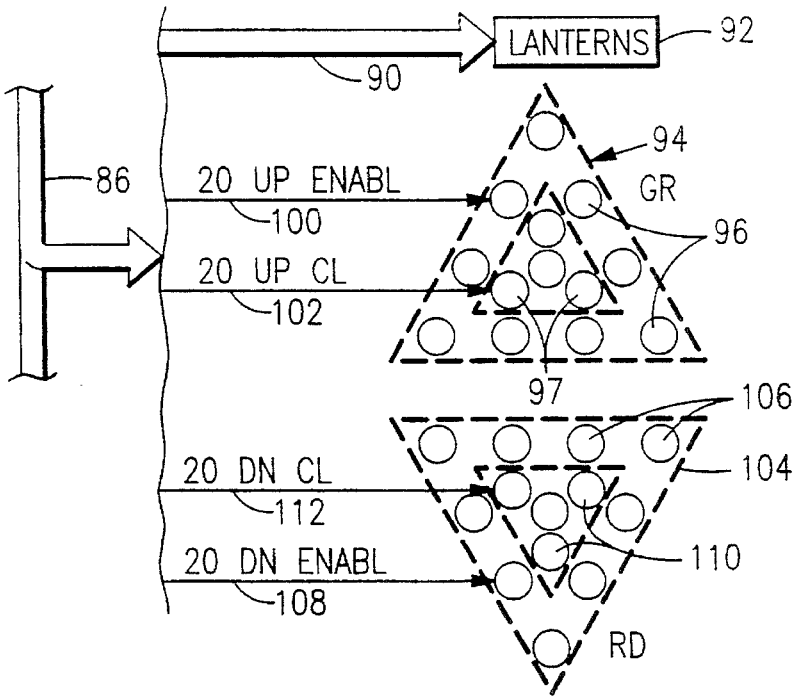
FIG. 6 is a simplified illustration of up and down hall call buttons incorporating the present invention.

In FIG. 5, the group controller 58 is also connected by a trunk of lines 86 to a riser 88 which comprises a set of up and down car arrival announcement lanterns and a set of up and down floor call buttons for each of the floors in the building, as illustrated for floor 20 in FIG. 6. The trunk of lines 86 will have suitable lines 90 going to the up and down hall lanterns 92, which may together comprise a lantern as disclosed in the aforementioned Proctor patent application, or may comprise conventional lanterns, none of which has anything to do with the present invention. An up hall call button 94 comprises a plurality of green LEDs 96, 97. As shown, there are nine LEDs 96 arranged in a hollow triangle (triangular ring), equivalent to the ring of FIGS. 1–4, which are illuminated together in response to an up enable signal (20 UP ENABL) on a line 100 for the 20th floor. This signal is indicative of available service and would be present whenever up calls can be made from the 20th floor, but would not be present whenever up hall calls are not permitted from the 20th floor (which would be true if the 21st floor were a private floor and such service were therefore not available). If up calls are not to be permitted from the 20th floor, then there would be no signal on the line 100 and the LEDs 96 would not be illuminated. As seen in FIG. 6, there are four LEDs 97 arranged in a triangular cluster each of which is illuminated in response to an up call acknowledgement signal (20 UP CL) on a line 102 for the 20th floor. This signal is equivalent to the signal on a line 82 for car calls as described with respect to FIG. 5. Thus if a call can be made, the outer triangle would glow; when a call requested by pressing a call button switch (which may comprise the center or the whole button 94) is recognized by the group controller 58 for service, the center portion in will glow response to the signal on the line 102. Similarly, a down hall call button 104 comprises nine red LEDs 106 arranged in a hollow triangle and illuminated in response to a signal (20 EN ENABL) on a down enable line 108 for the 20th floor, and four green LEDs 110 arranged in a central triangular cluster and illuminated in response to a down call acknowledgement signal (20 DN CL) on a line 112 for the 20th floor. This is another aspect of the invention: the invention may be utilized to provide indications of available service and call registration for each direction of hall calls, as well as for car calls. This aspect of the invention may be utilized in conjunction with security of many types known in the art, on any floor, in either direction, for many different reasons, in addition to that described hereinbefore and in the aforementioned Kupersmith et al application.

Figure 7:
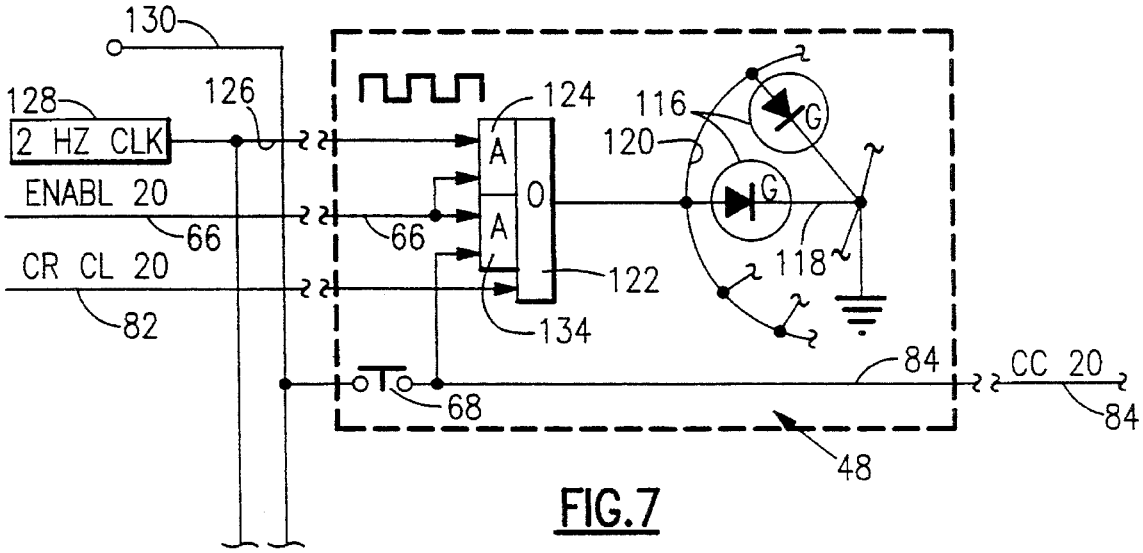
FIG. 7 is a partial, simplified schematic block diagram of a car call button of the type illustrated in FIG. 3.

A call button 48 of the type illustrated in FIG. 3 is shown in more detail in FIG. 7. Therein, a ring of green light emitting diodes 116 have suitable connections 118 to ground and are illuminated by virtue of a signal on a line 120 from an OR gate 122. Initially, as passengers enter a car at the lobby, since the 20th floor is (in this example) a floor to which service is permitted, there will be an enable signal on the line 66 for the 20th floor which will enable an AND gate 124 to be responsive to periodic pulses on a line 126 which may originate, for instance, in a 2 hertz clock 128. This provides the intermittent illumination (flashing) of the green rings as described hereinbefore with respect to FIG. 3. The actual frequency of the wave provided on the line 126 should be selected so as to give easily recognized notice from a quick glance without being so fast as to merely flicker. Thus, frequencies in the range of 2–4 hertz are probably best but may be selected to suit any implementation of the present invention without altering the same. Assuming that a passenger desires to enter a call for the 20th floor, pressing the car call button switch 68 will cause a signal on a line 130 from a voltage source to become a car call request signal on the line 84 for the 20th floor. In this case, since the signal can be passed through the switch 68 with respect to the floor whether it is enabled or not, the screening of the car call must occur within the controller 60 as is known to the prior art. Since this is an enabled floor, it is likely that the car call request will be registered and therefore a car call acknowledgement signal will appear on the line 82 for the 20th floor, which signal will then pass through the OR gate 122 and being a steady signal will cause the green LEDs 116 to glow in a steady fashion. It is customary in prior art car call arrangements to momentarily light the car call button while the button switch is pressed, and to permanently light it once the call is acknowledged by the controller 60. This sort of operation is accommodated in the embodiment of FIG. 7 by means of an AND circuit 134 which will sense the presence of the car call request signal on a line 84 whenever the floor is enabled as indicated by a signal on the line 66. Therefore, pressing of the car call button switch 68 will cause the AND circuit 134 to pass a signal through the OR gate 122 and cause non-flashing illumination of the LEDs 116. This feature need not necessarily be used unless it is desired, and has nothing to do with the present invention. The use of the term "registering" hereinafter includes both requesting the service and acknowledgement thereof.

Figure 8:
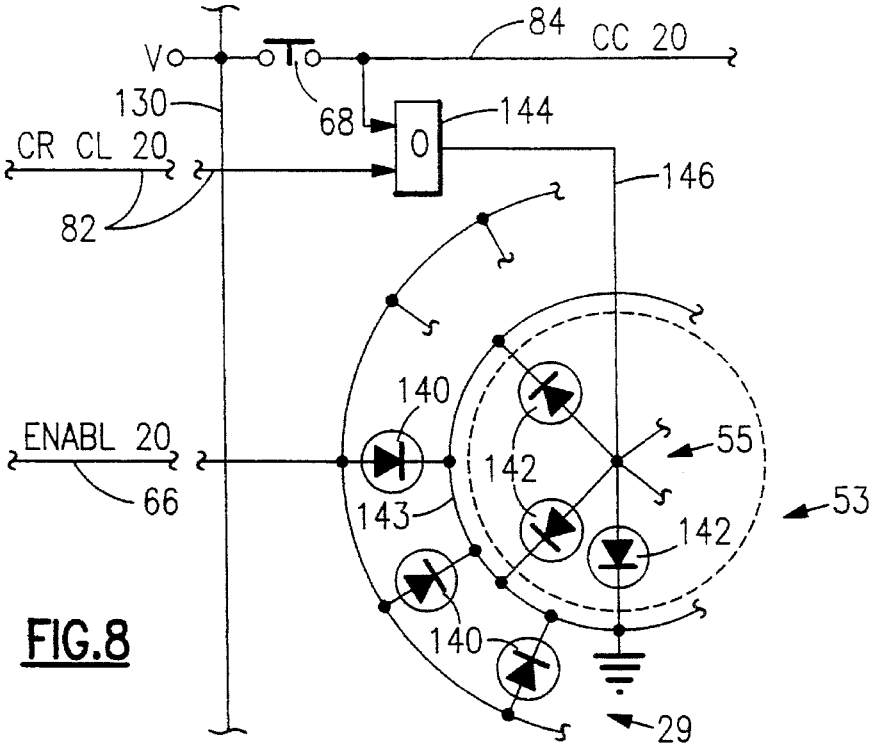
FIG. 8 is a partial, simplified schematic block diagram of a car call button of the type illustrated in FIG. 4.
Figure 9:
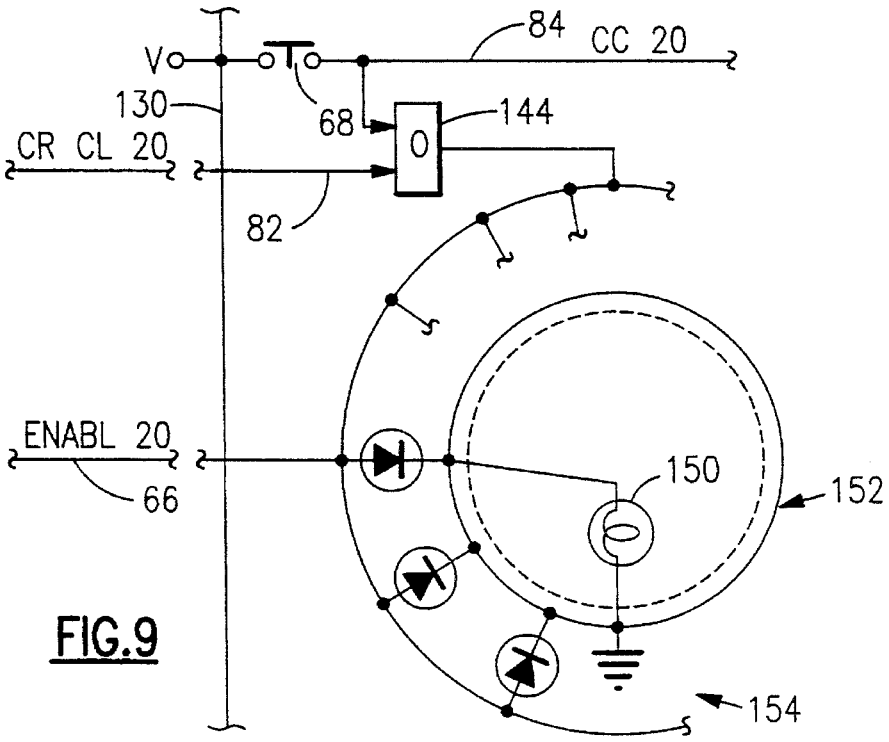
FIG. 9 is a partial, simplified schematic block diagram of a car call button in which the availability of service is indicated by illumination of the center and the registering of a car call is indicated by illumination of a ring surrounding the center.

Referring now to FIG. 8, the manner of implementing the present invention which is illustrated in FIG. 4 comprises a car call button 53, the ring of which 29 contains a plurality of (such as 10) suitable colored LEDs 140 and a center portion 55 having a suitable number (such as 5–8) LEDs 142; both have attachments 143 to ground. If the 20th floor is a floor to which service is permitted, the enable signal will be present on the line 66 thereby illuminating all of the LEDs 140 in a steady fashion, indicating that the 20th floor is available. If a call is entered by pressing the switch 68, an OR gate 144 will provide a signal on a line 146 to cause the LEDs 142 to illuminate, as in the prior art. And, if the car call is registered by the controller 60, then the car call acknowledgement signal on the line 82 for the 20th floor will cause the OR gate 144 to continue to illuminate the LEDs 142 by virtue of the signal on the line 146. Of course, the roles of the center and the ring may be reversed, causing the enable signal on the line 66 to enable the center portion 55 and the car call request and acknowledgement signals to illuminate the ring 29. This is illustrated in FIG. 9 in which the enable signal on the line 66 will cause a light bulb 150 to illuminate the center portion 152 of a car call button for the 20th floor, and the car call request signal on the line 84 or the car call acknowledgement signal on the line 82 to provide a signal from OR gate 144 on a line 158 which illuminates the ring 154 of the car call button 152. Of course this could also be reversed so as to operate in the manner of FIG. 8 while using a light bulb 150 in the center.

Figure 10:
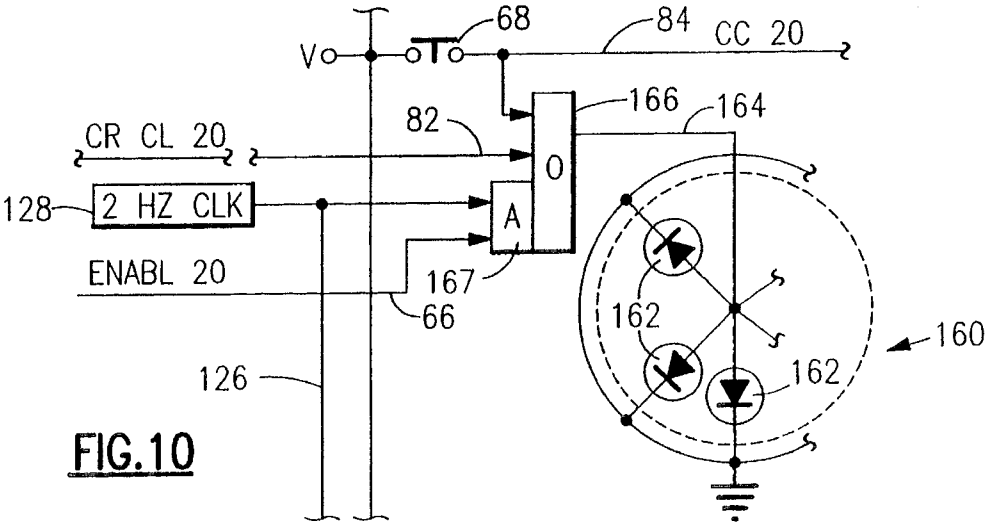
FIG. 10 is a partial, simplified schematic block diagram of a car call button in which flashing illumination indicates the availability of service and steady illumination indicates the registering of a call.

In FIG. 10, a car call button 160 may either comprise the center of a ring button as of the type illustrated in FIGS. 1–4 or may comprise the whole button (either round as shown or square as is known) of a prior art call button. It is common for such call buttons to illuminate once they are pressed to activate the car call request button switch 68 which is associated therewith. The illumination may occur as a result of a plurality of LEDs 162, or a suitable bulb could be used (such as the bulb 150 of FIG. 9). The LEDs 162 are illuminated by a signal on a line 164 from an OR gate 166 which is normally first operated by an AND gate 167 in response to the enablement signal on the line 66 and the repetitions of the two hertz clock signal on the line 126. Thus, the button 160 will illuminate in a flashing manner to indicate the availability of the 20th floor for service. When the car call button switch 68 is pressed, the signal on the line 84 will cause the OR gate 164 to illuminate the LEDs 162 in a steady fashion so long as the switch is closed, thus providing an indication to the passenger that the call request is in fact being made. When the call is registered, the signal on the line 82 will pass through the OR gate 166 and cause a constant signal on line 164 so that the hall call button 160 will be illuminated in a steady fashion, indicating that the request for service to the 20th floor has been registered.

Figure 11:
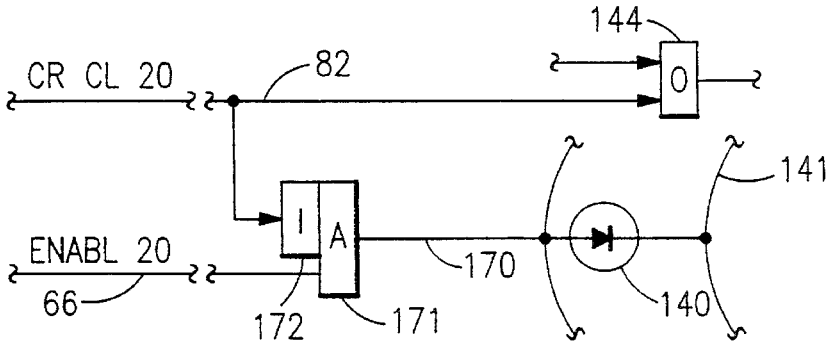
FIG. 11 illustrates a variant of FIGS. 4 and 8.

One variant of a method for practicing the invention is like that of FIGS. 4 and 8, but shutting off the ring once the center is illuminated, as shown in FIG. 11. This is achieved by illuminating the LEDs 140 of the ring 29 by a line 170 from an AND gate 171 which is blocked by an inverter 172 whenever the registration of the call is indicated on the line 82. Another variant is the converse of FIG. 11—having the center indicate availability until the ring indicates registration. A variant of the invention using a red ring to indicate unavailability, a green ring to indicate availability and a lit center to indicate a registered call may be adapted from FIGS. 5, 8 and 11 in an obvious manner (as can still other variants of color, center vs. ring, etc). And solid red, flashing green availability can be combined with solid green registrations in a manner which is obvious in view of the foregoing.

Another embodiment of the invention may be implemented in a fashion similar to that illustrated in FIGS. 2 and 5 by having rings of the call buttons which are relatively dull and unattractive when not illuminated, and for which even a slight amount of illumination of a suitable color (such as a vivid amber) will provide a significantly different look. Increasing the intensity of the single color of light may indicate that a car call has been registered. This may be achieved either by supplying only partial operating current to indicate enablement and full operating current to indicate a registered call, or about half of the diodes (such as five of them) may be illuminated to indicate enablement, and the remaining diodes illuminated to indicate registration of the call. The invention encompasses still other combinations and variations in the manner of providing plural illuminated indications of the availability of service (either to a floor or from a floor in either direction) and the registering of a call for service to such floor or from such floor in such direction.

For simplicity, isolation, voltage connection, and powering circuitry, which may be required in some implementations of the invention, have not been shown herein. All of that is within the skill and choice of the art.

The embodiment of FIG. 10 may easily be utilized (perhaps with the bulb of FIG. 9) to retrofit existing round or square illuminated car call buttons by simply providing the additional two hertz clock signal to each elevator shaft and the additional enable line 66, AND gate 168, and OR gate 166 for each floor in each car operating panel. The invention may, of course, be used with any shape call buttons and in a variety of button configurations. The embodiment of FIG. 7 similarly allows retrofitting of existing ring-type car call buttons (such as retrofitting the buttons of FIG. 1). On the other hand, the embodiment of FIGS. 2 and 5 is advantageous in that the existing call button hardware is easily adapted by simply substituting the dual light LEDs 74 for single light LEDs 116 (FIG. 5), for use with the relatively simple additional logic circuitry. The manner of implementing the present invention is irrelevant, and may be selected from the variety described herein (and other variants) in order to provide the desired appearance and other cost and accommodation characteristics to suit any utilization of the present invention. Similarly, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. Apparatus including call button assemblies for separately indicating to elevator passengers elevator service which may be requested by operating a call button switch and elevator service requests which have been registered, comprising:

a controller for providing, for each call button assembly by means of which a passenger may select service, an enable signal indicating that the service corresponding to such call button assembly is available, and for providing, in response to operation by a passenger of a call button switch within a call button assembly corresponding to service which is available to passengers, a call signal indicating that a call for such service has been registered; and a plurality of said call button assemblies, said call button assemblies being visible to passengers at all times, each including a call button switch which may be actuated by passengers to request service corresponding thereto, each operative in response to a corresponding one of said enable signals to provide intermittent illumination, each operative in response to a corresponding one of said call signals to provide invariant illumination, said call button assemblies emanating either the intermittent illumination or the invariant illumination from the same portion thereof.

2. Apparatus including call button assemblies for separately indicating to elevator passengers elevator service which may be requested by operating a call button switch and elevator service requests which have been registered, comprising:

a controller for providing, for each call button assembly by means of which a passenger may select service, an enable signal indicating that the service corresponding to such call button assembly is available, and for providing, in response to operation by a passenger of a call button switch within a call button assembly corresponding to service which is available to passengers, a call signal indicating that a call for such service has been registered; and a plurality of said call button assemblies, said call button assemblies being visible to passengers at all times, each including a call button switch which may be actuated by passengers to request service corresponding thereto, each operative in response to a corresponding one of said enable signals to provide illumination of a first color, each operative in response to a corresponding one of said call signals to provide illumination of a second color visually distinct from said first color, said call button assemblies emanating either the illumination of the first color or the illumination of the second color from the same portion thereof.

3. A method of distinctly indicating visually to elevator passengers service which is available to passengers and requests for service which have been registered, comprising:

providing call button assemblies, which are visible to passengers at all times, each corresponding to service which is potentially selectable by elevator passengers;

providing illumination intermittently to create a flashing impression from a portion of each of said call button assemblies which corresponds to service which is currently available to passengers while not providing such illumination within call button assemblies which correspond to service which is not currently available to passengers; and providing said illumination in a steady state fashion to create an invariant impression from said portion of each of said call button assemblies for which a request for the corresponding service has been registered.

4. A method of distinctly indicating visually to elevator passengers service which is available to passengers and requests for service which have been registered, comprising:

providing call button assemblies, which are visible to passengers at all times, each corresponding to service which is potentially selectable by elevator passengers;

providing illumination of a first color within each of said call button assemblies which corresponds to service which is currently available to passengers, while not providing such illumination within call button assemblies which correspond to service which is not currently available to passengers; and providing illumination of a second color distinct from said first color in place of the illumination of said first color within each of said call button assemblies for which a request for the corresponding service has been registered.

* * * * *